US007112152B1

(12) United States Patent
Chen

(10) Patent No.: US 7,112,152 B1
(45) Date of Patent: Sep. 26, 2006

(54) HITTING TRAINING AID

(75) Inventor: Shyan-Wei Chen, Taipei Hsien (TW)

(73) Assignee: Racer Sporting Goods Co., Ltd., Taipei Hsien (TW)

( * ) Notice: Subject to any disclaimer, the term of this patent is extended or adjusted under 35 U.S.C. 154(b) by 0 days.

(21) Appl. No.: 10/969,986

(22) Filed: Oct. 22, 2004

(51) Int. Cl.
*A63B 69/00* (2006.01)
*A63B 59/00* (2006.01)

(52) U.S. Cl. ..... 473/457; 473/564

(58) Field of Classification Search ..... 473/457, 473/437, 422, 451, 564–567
See application file for complete search history.

(56) References Cited

U.S. PATENT DOCUMENTS 3,463,492 A * 8/1969 White ..... 473/453
3,809,397 A * 5/1974 Gruenewald ..... 473/457
5,100,148 A * 3/1992 Smith ..... 473/228
5,150,897 A * 9/1992 Wortman ..... 473/567
5,184,825 A * 2/1993 Ruth ..... 473/228
5,207,625 A * 5/1993 White ..... 482/111
5,395,107 A * 3/1995 De Pippo ..... 473/451
5,571,048 A * 11/1996 Kenney ..... 473/228
6,881,156 B1 * 4/2005 Phillips ..... 473/228

* cited by examiner

*Primary Examiner*—Mitra Aryanpour
(74) *Attorney, Agent, or Firm*—Troxell Law Office, PLLC

(57) ABSTRACT

A training aid for use with an elongated sporting implement for hitting training is disclosed to include three vane devices injection-molded from plastics each vane device having a flat vane body and smoothly arched top and bottom locating plates disposed near top and bottom ends of the inner vertical side of the flat vane body for enabling the vane devices to be adjustably connected to one another around the sporting implement through a plug joint, and two fastening belts inserted through insertion slots in the flat vane body of each vane device and fastened up to affix the vane devices to the sporting implement. Top and bottom stop devices are attached when the training aid is used with a golf club.

3 Claims, 9 Drawing Sheets

HITTING TRAINING AID

BACKGROUND AND SUMMARY OF THE INVENTION

The present invention relates to a sports training aid and more particularly, to a hitting training aid that can quickly and detachably be installed in the sporting implement for hitting training.

U.S. Pat. No. 5,395,107 discloses a training aid for developing strength and coordination for a person's swing in swinging a sporting implement, such as a baseball bat, used to strike an object. This design of training aid, as shown in FIGS. 1–4 includes a plurality of vanes 7 attached to first and second collars 8,9. This structure of training aid is still not satisfactory in function because of the following drawbacks:

1. The mounting and dismounting procedures of the training aid are complicated and time wasting. During installation, the user must fasten the retaining portions 71 and 72 of every vane 7 to the slots 81,82,91,92 at the first and second collars 8,9 respectively. When detaching the training aid from the sporting implement 90, the user must disengage the retaining portions 71 and 72 of every vane 7 from the slots 81,82,91,92 at the first and second collars 8,9 respectively.

2. The vanes 7 attached and the first and second collars 8,9 are different members that must be separately made with different molds. Further, for fitting different sizes of sporting implements, different sizes of training aid parts should be prepared, thereby resulting in a high manufacturing cost.

3. The slot 73 in each vane 7 has a certain length. After installation of a belt (not shown) in the slots 73 of the vanes 7, the belt may slip in the slots 73.

The present invention has been accomplished under the circumstances in view. It is therefore one object of the present invention to provide a hitting training aid that can quickly and detachably be installed in the sporting implement for hitting training. It is another object of the present invention to provide a hitting training aid, which is inexpensive to manufacture. It is still another object of the present invention to provide a hitting training aid, which fits sporting implements having different diameters. It is still another object of the present invention to provide a hitting training aid, which can be used with a golf club for gold ball hitting training.

To achieve these and other objects of the present invention, the hitting training aid comprises three vane devices injection-molded from plastics each vane device having a flat vane body and smoothly arched top and bottom locating plates disposed near top and bottom ends of the inner vertical side of the flat vane body for enabling the vane devices to be adjustably connected to one another around the sporting implement through a plug joint, and two fastening belts inserted through insertion slots in the flat vane body of each vane device and fastened up to affix the vane devices to the sporting implement. By means of adjusting the engaging depth of respective plug rods in the respective plugholes, the hitting training aid fits sporting implements having different diameters. Further, top and bottom stop devices are attached when the training aid is used with a golf club.

DETAILED DESCRIPTION OF THE INVENTION

Figure 1:
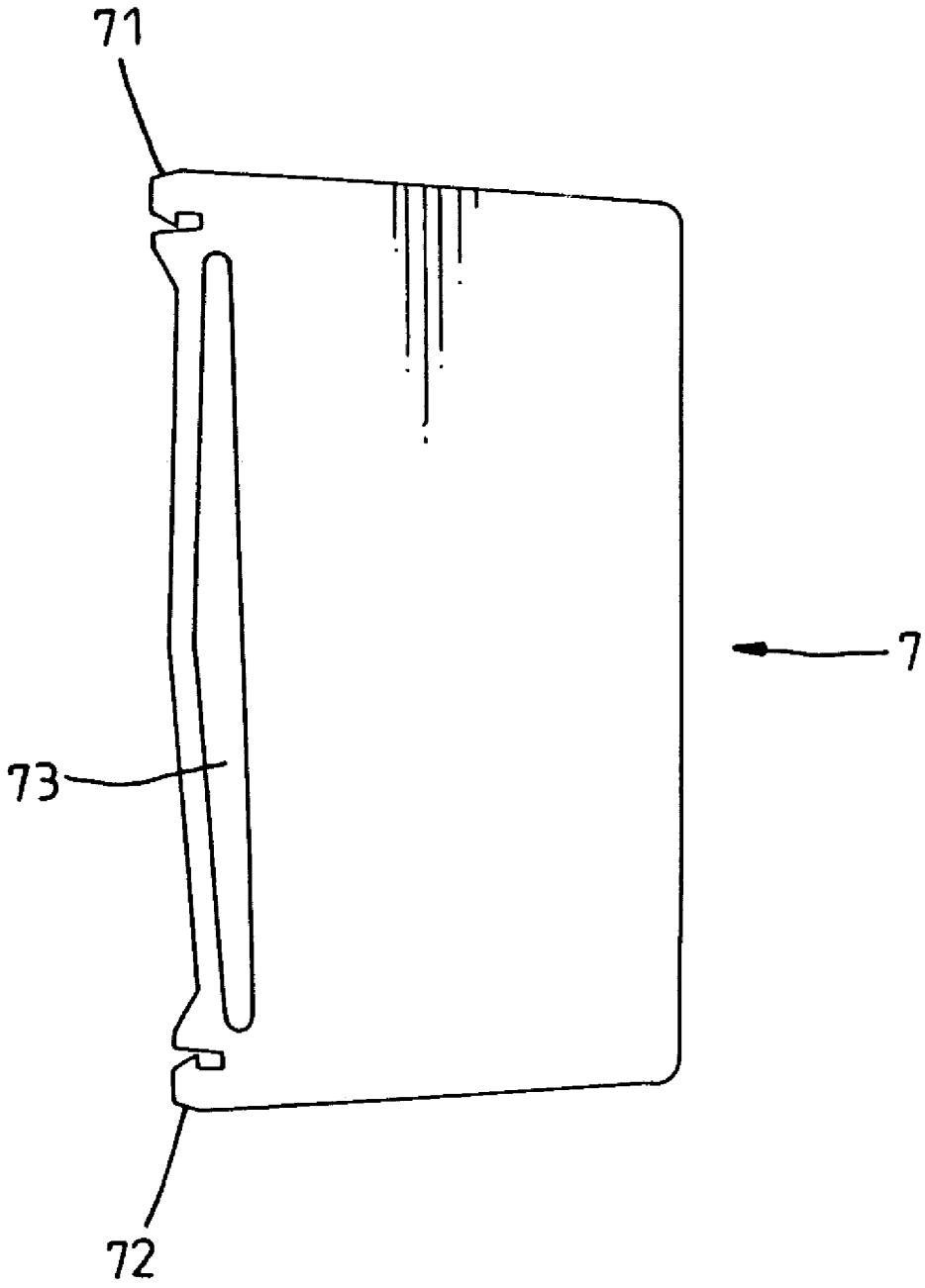
Fig. 1 PRIOR ART
FIG. 1 is a front elevational view of a vane used in a training attachment unit conventionally made in accordance with U.S. Pat. No. 5,395,107.
Figure 3:
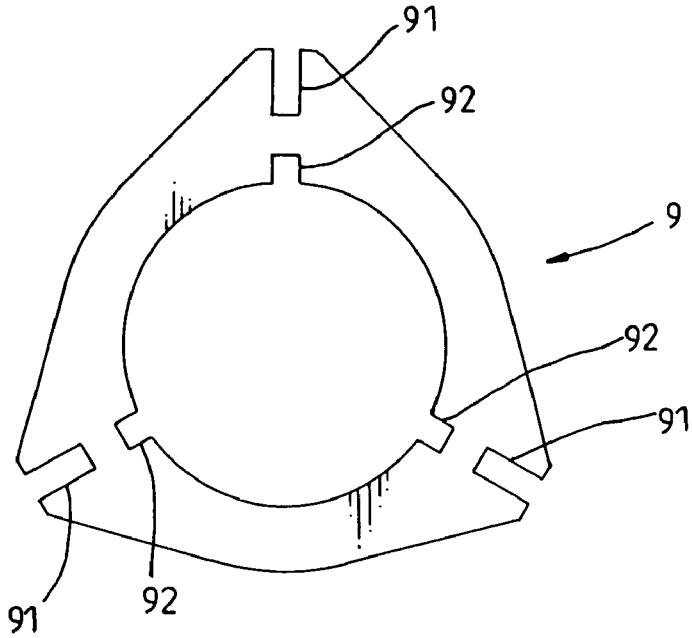
Fig. 3 PRIOR ART
FIG. 3 is a top view of a second collar used in the training attachment unit conventionally made in accordance with U.S. Pat. No. 5,395,107.
Figure 2:
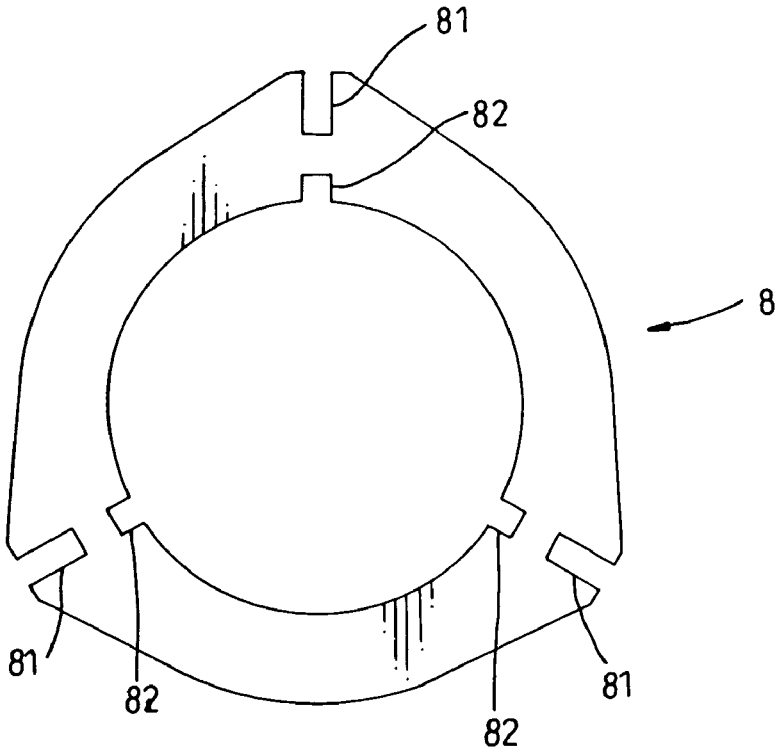
Fig. 2 PRIOR ART
FIG. 2 is a top view of a first collar used in the training attachment unit conventionally made in accordance with U.S. Pat. No. 5,395,107.
Figure 4:
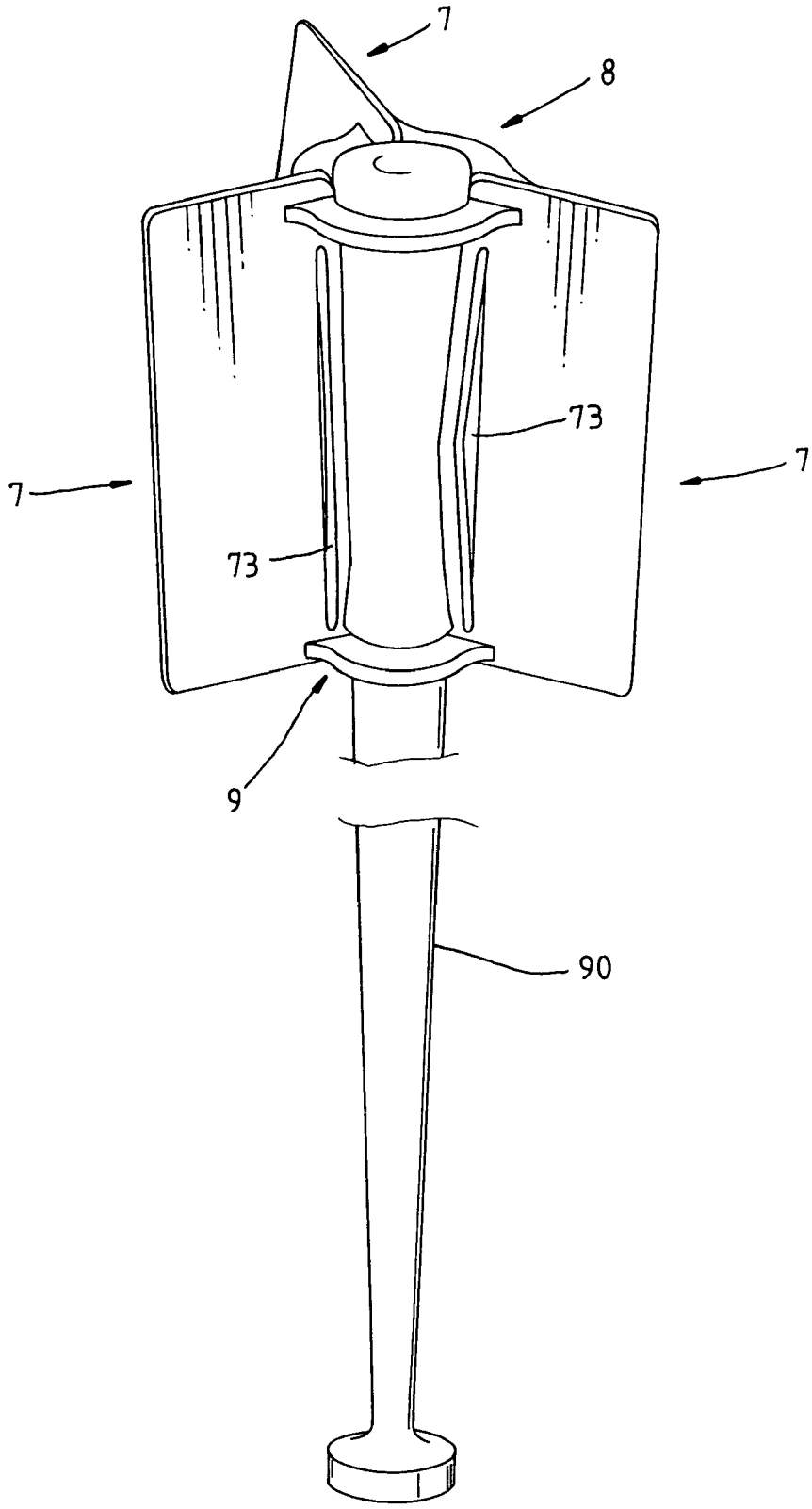
Fig. 4 PRIOR ART
FIG. 4 is a perspective view of the training attachment unit conventionally made in accordance with U.S. Pat. No. 5,395,107.
Figure 5:
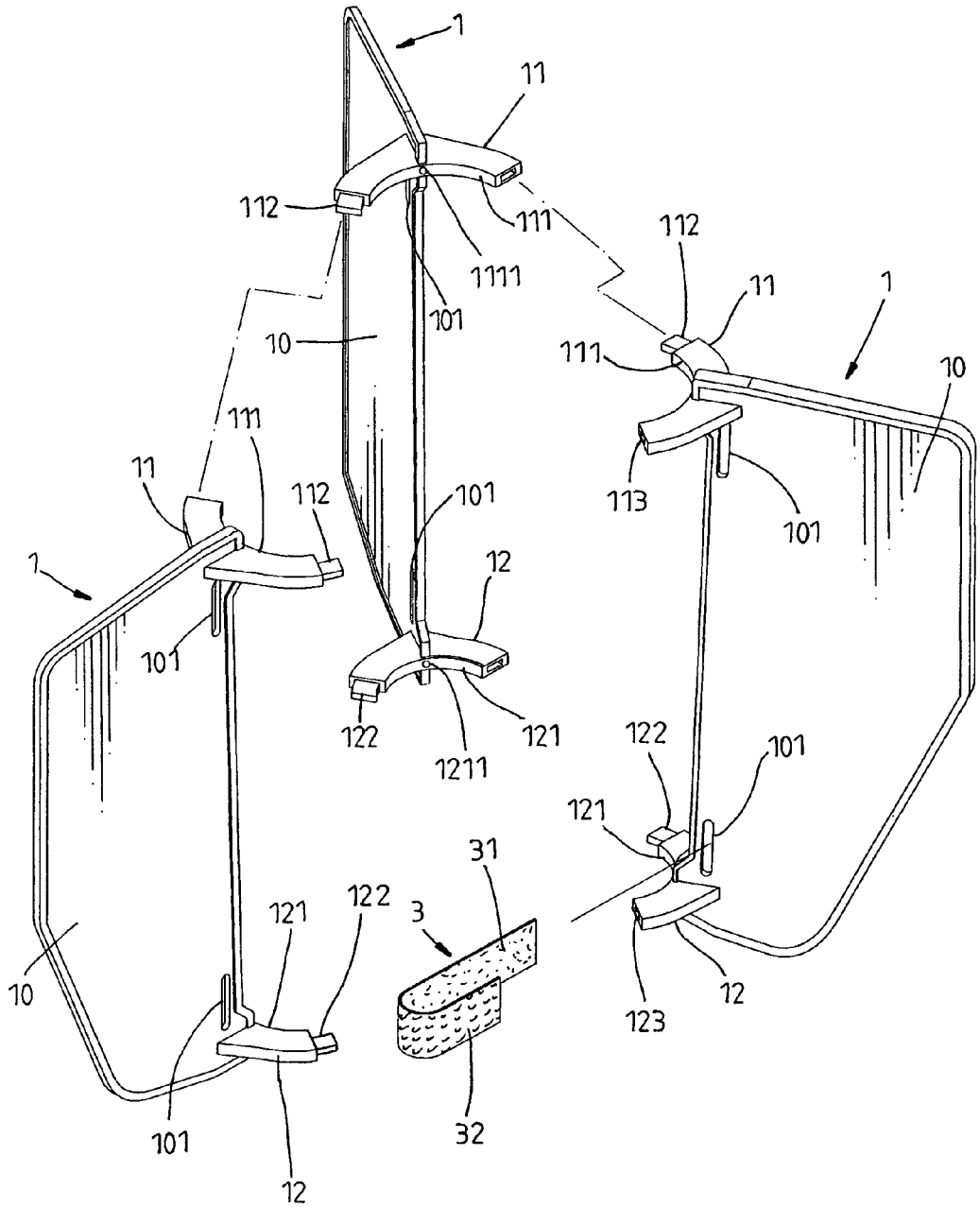
FIG. 5 is an exploded view of a hitting training aid according to the present invention.
Figure 6:
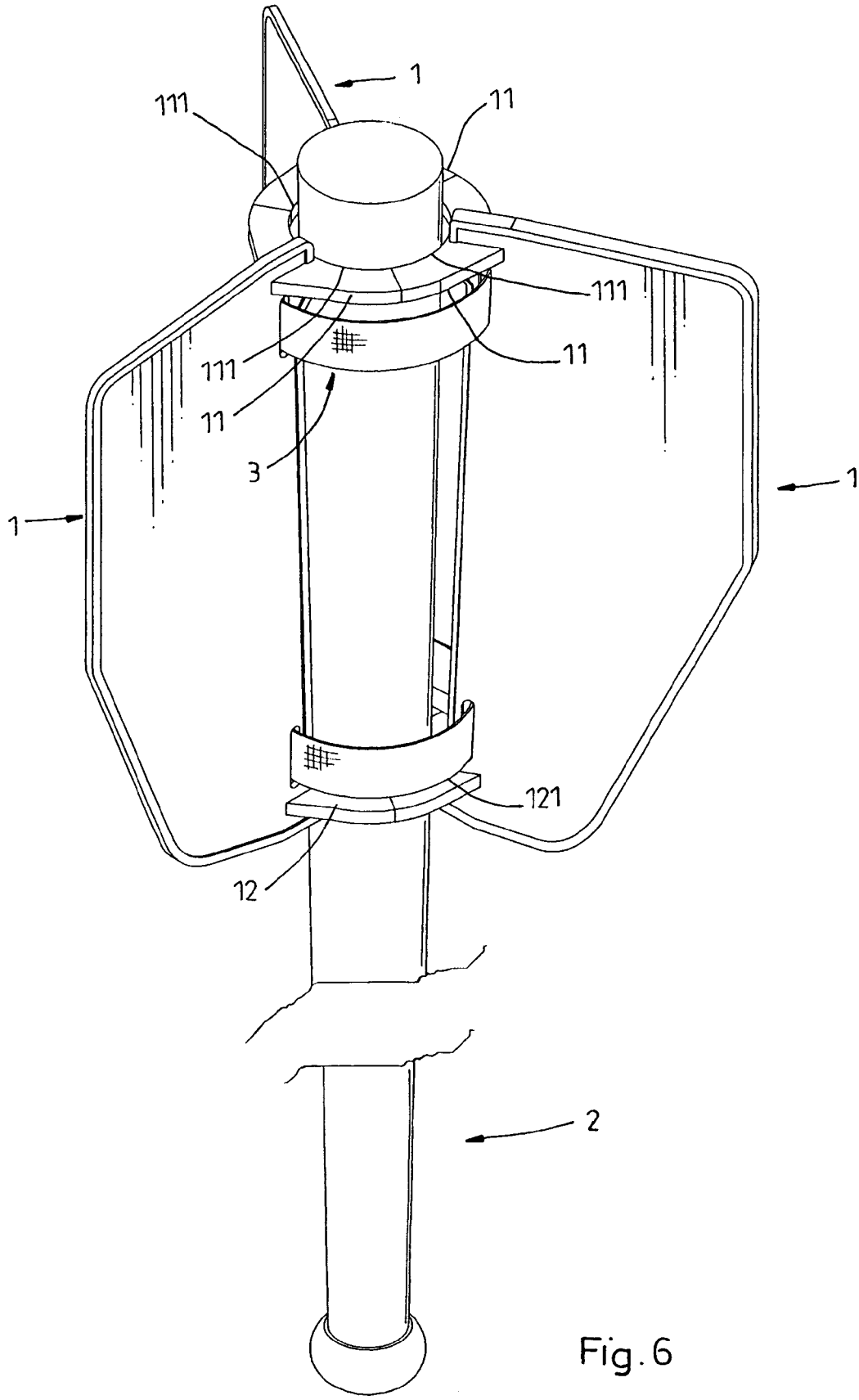
FIG. 6 is a perspective view showing the hitting training aid fastened to a baseball bat according to the present invention.

Referring to FIGS. 5~6, a hitting training aid in accordance with the present invention is for attaching to a sporting implement, for example, a baseball bat 2 for hitting training to help the user develop strength and coordination. The hitting training aid is comprised of three vane devices 1 that are connectable to one another around the periphery of the barrel of the bat 2, and two fastening belts 3 for tying up the vane devices 1 to affix the vane devices 1 to the barrel of the bat 2.

The vane devices 1 are identical. Preferably, the vane devices 1 are injection-molded from plastics. Each vane device 1 comprises a flat vane body 10, a relatively bigger top locating plate 11 and a relatively smaller bottom locating plate 12 respectively formed integral with one vertical side of the flat vane body 10 near the top and bottom ends and extending in horizontal direction across the flat vane body 10, and two insertion slots 101 respectively cut through the flat vane body 10 at different elevations adjacent to the top locating plate 11 and the bottom locating plate 12. The top locating plate 11 and the bottom locating plate 12 each have a circularly arched contact wall 111 or 121 that is kept in close contact with the periphery of the barrel of the bat 2 after installation of the vane devices 1 in the bat 2, a plug rod 112 or 122 formed in one end, and a plug hole 113 or 123 formed in the other end. The fastening belts 3 are provided with a male fastener 31 and a female fastener 32 for adjustably joining the ends. According to this embodiment, the male fastener 31 and the female fastener 32 are hook and loop materials.

By means of plugging the plug rods 112 and 122 of one vane devices 1 to the plug holes 113 and 123 of another, the vane devices 1 are connected together around the periphery of the barrel of the bat 2 with the circularly arched contact walls 111 and 121 kept in close contact with the periphery of the barrel of the bat 2. After installation of the vane devices 1 in the bat 2, the fastening belts 3 are respectively inserted through the insertion slots 101 of the vane devices 1 and fastened up to affix the vane devise 1 to the bat 1.

Figure 7:
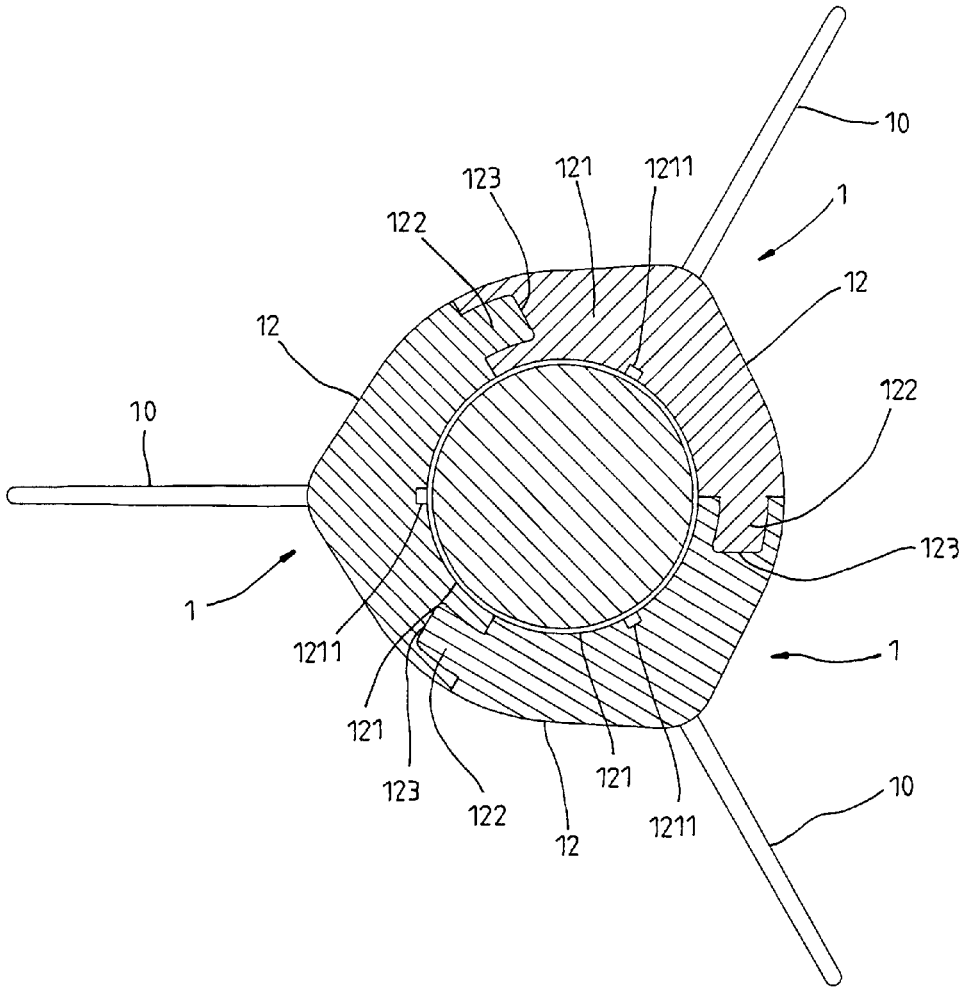
FIG. 7 is a top view in section of FIG. 6.
Figure 8:
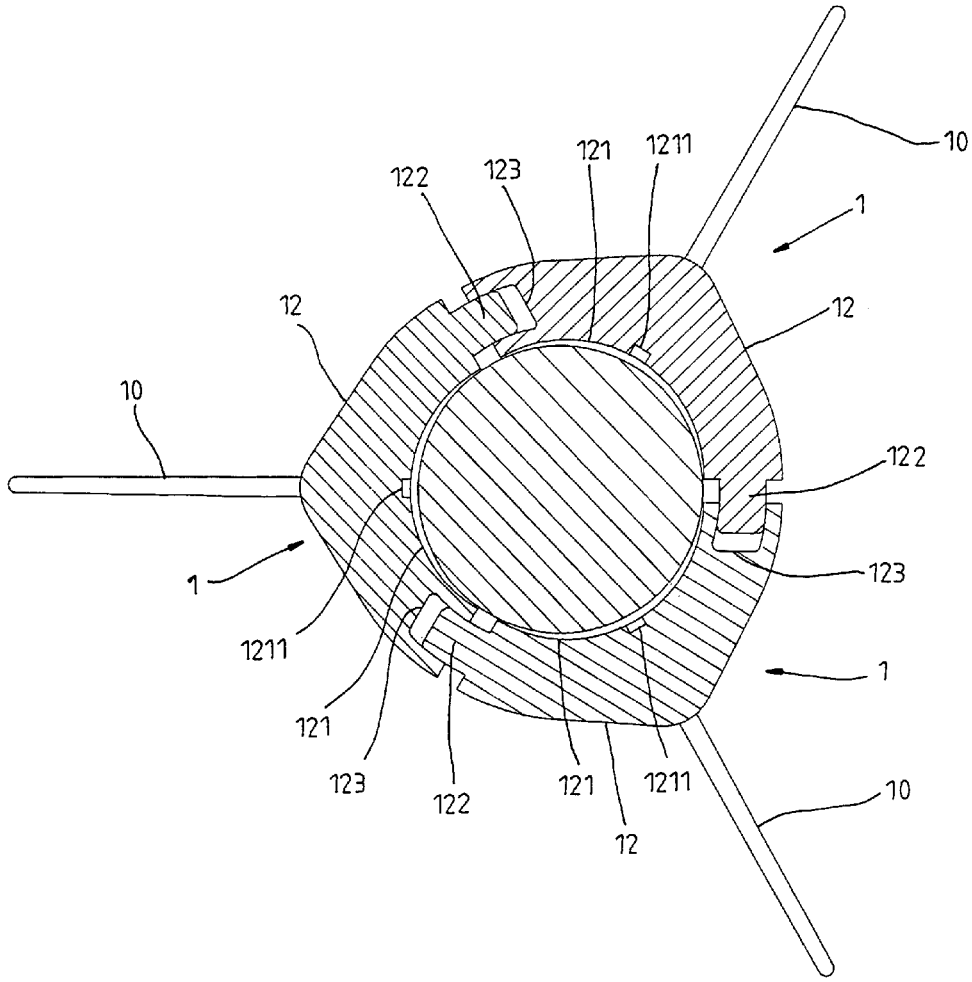
FIG. 8 is top view in section showing the hitting training aid fastened to a relatively bigger baseball bat according to the present invention.

Referring to FIGS. 7 and 8, by means of adjusting the engaging depth of the respective plug rods 112 and 122 in the respective plug holes 113 and 123, the hitting training aid fits different bats having different diameters.

Figure 9:
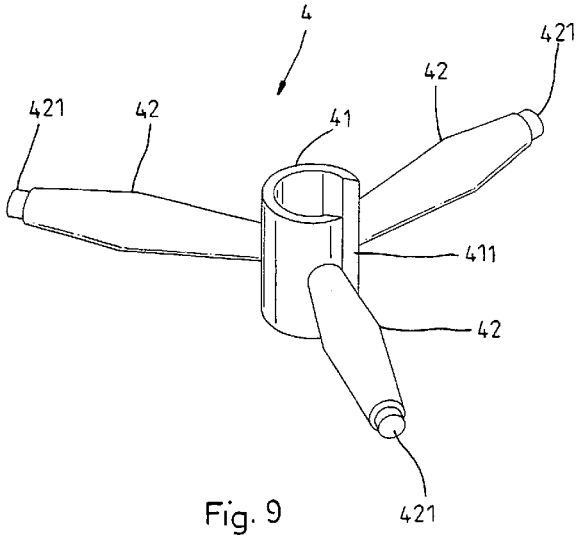
FIG. 9 is an elevational view of a top stop device for use with the hitting training aid according to the present invention.
Figure 10:
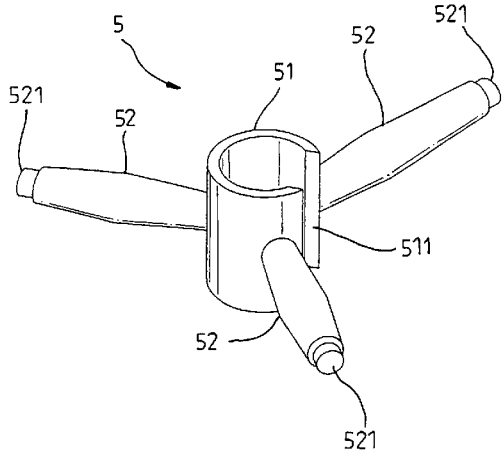
FIG. 10 is an elevational view of a bottom stop device for use with the hitting training aid according to the present invention.
Figure 11:
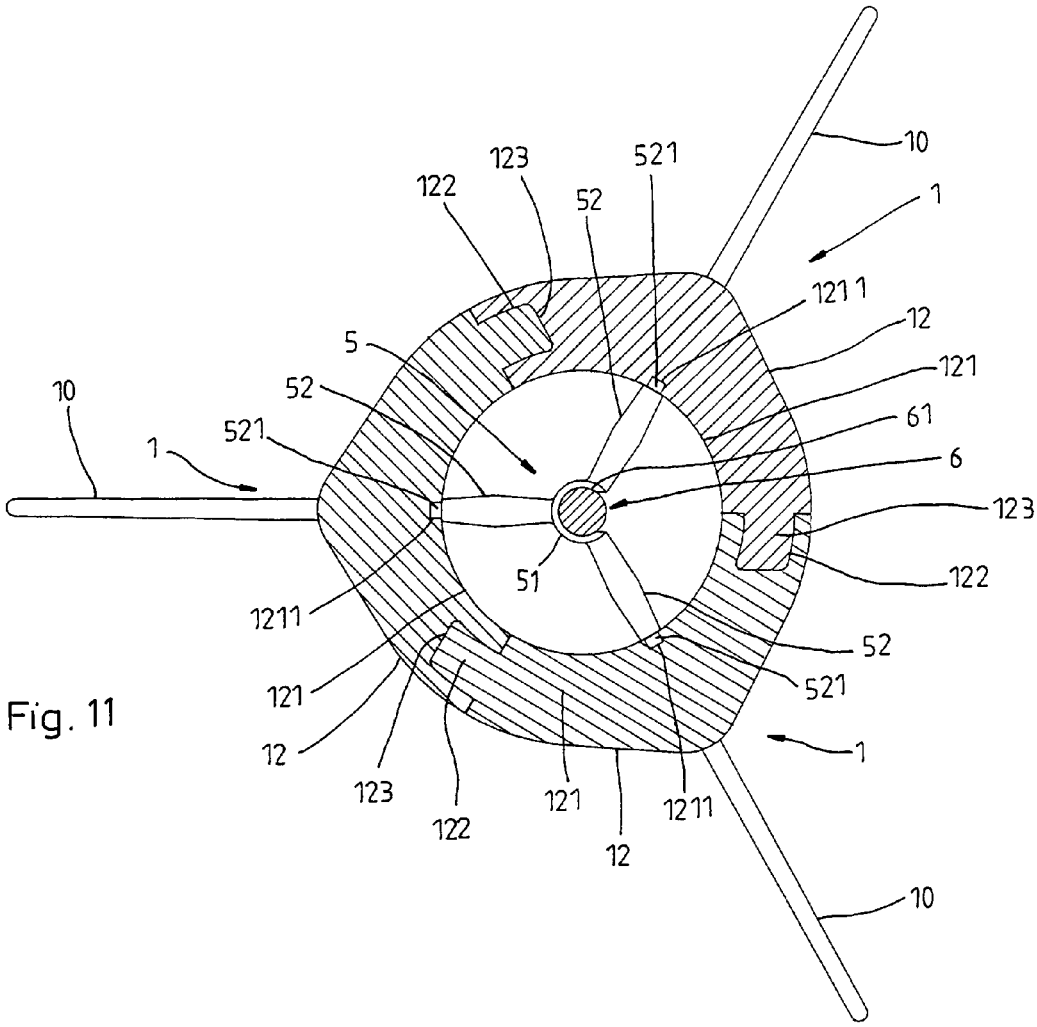
FIG. 11 is a top view in section showing the top stop device and bottom stop device fastened with the hitting training aid to the shaft of a golf club according to the present invention.

Referring to FIGS. 9 and 10, top and bottom stop devices 4 and 5 may be fastened to the sporting implement and respectively stopped at the top side of the top locating plates 11 of the vane devices 1 and the bottom side of the bottom locating plates 12 of the vane devices 1. According to this embodiment, the sporting implement is a golf club 6, and the hitting training aid is attached to the lower end of the shaft 61 of the golf club 6. The stop devices 4 and 5 comprise each a split barrel 41 or 51, which has a crevice 411 or 511 longitudinally extended through the top and bottom sides, and three radial rods 42 or 52 equiangularly spaced around and radially extended from the periphery of the split barrel 41 or 51. The radial rods 42 and 52 each have the respective free end terminating in a positioning rod 421 or 521 that engages a respective top locating notch 1111 at the top side of the top locating plate 11 of the respective vane device 1 or bottom locating notch 1211 at the bottom side of the bottom locating plate 12 of the respective vane devices 1.

As indicated above, the invention has the following advantages:

1. By means of the matching design between the respective plug rods 112 and 122 and the respective plug holes 113 and 123, the hitting training aid can rapidly and easily be detachably fastened to a sporting implement for training.

2. The vane devices 1 are identical and can be injection-molded from plastics through one single molding mold to reduce the manufacturing cost.

3. By means of adjusting the engaging depth of the respective plug rods 112 and 122 in the respective plug holes 113 and 123, the hitting ball training aid fits sporting implements having different diameters.

4. Top and bottom stop devices 4 and 5 may be used and fastened with the hitting training aid to the shaft 61 of a golf club 6 for golf ball hitting training.

What is claimed is:

1. A hitting training aid for use with an elongated sporting implement used for striking objects comprising a plurality of vane devices connectable to one another around the periphery of an elongated sporting implement, and at least one fastening belt for fastening said plurality of vane devices together around the periphery of the elongated sporting implement, wherein each of said plurality of vane devices comprises a flat vane body, a relatively bigger top locating plate and a relatively smaller bottom locating plate respectively formed integral with a vertical side of said flat vane body near the top and bottom ends of said flat vane body and extending in a horizontal direction across said flat vane body, and at least one insertion slot cut through said flat vane body adjacent to each one of said top locating plates and said bottom locating plates, each of said top locating plates and said bottom locating plates having a circularly arched contact wall for contacting the periphery of the sporting implement with which the hitting training aid is to be used, a plug rod formed in one end thereof, and a plug hole formed in an opposite end thereof, the plug rods of each of said top and bottom locating plates being pluggable into the plug holes of said opposite top and bottom locating plates; said at least one fastening belt is respectively inserted through the at least one insertion slot of each of said vane device, said at least one fastening belt having hook and loop material for joining the ends thereof.

2. The hitting training aid as claimed in claim 1, wherein said plurality of vane devices are injection-molded from plastics.

3. The hitting training aid as claimed in claim 1, further comprising a top stop device and a bottom stop device for fastening to the sporting implement in which the hitting around aid is installed for stopping at a top side of the top locating plates of said plurality of vane devices and at a bottom side of the bottom locating plates of said plurality of vane devices respectively, said top stop device and said bottom stop device each comprising a split barrel, which has as crevice longitudinally extended through top and bottom sides thereof, and a plurality of radial rods equiangularly spaced around and radially extended from the periphery of said split barrel, said radial rods each having a respective free end terminating in a positioning rod that is engageable into a respective locating notch at one of the top locating plate and bottom locating plate of one of said plurality of vane devices.

* * * * *